United States Patent [19]

Zitzen

[11] Patent Number: 4,725,015

[45] Date of Patent: Feb. 16, 1988

[54] ROTATING DRIVEN BRAKE PLATE APPARATUS OF A YARN TENSIONING DEVICE

[75] Inventor: Wilhelm Zitzen, Monchen-Gladbach, Fed. Rep. of Germany

[73] Assignee: W. Schlafhorst & Co., Monchen-Gladbach, Fed. Rep. of Germany

[21] Appl. No.: 894,692

[22] Filed: Aug. 8, 1986

[30] Foreign Application Priority Data

Aug. 13, 1985 [DE] Fed. Rep. of Germany ..... 3528937

[51] Int. Cl.[4] ..... B65H 59/22

[52] U.S. Cl. ..... 242/150 R

[58] Field of Search ..... 242/150 R, 150 M, 147 R, 242/149, 131, 131.1

[56] References Cited

U.S. PATENT DOCUMENTS

| | | | |
|---|---|---|---|
| 1,965,363 | 7/1934 | Abbott | 242/150 R |
| 3,695,548 | 10/1972 | Abbott | 242/150 R |
| 4,272,038 | 6/1981 | Wildi | 242/150 R |
| 4,548,369 | 10/1985 | Bossart | 242/150 R |
| 4,572,459 | 2/1986 | Kamp et al. | 242/150 R |

*Primary Examiner*—Stanley N. Gilreath

*Attorney, Agent, or Firm*—Herbert L. Lerner; Laurence A. Greenberg

[57] ABSTRACT

A rotating driven brake plate apparatus of a yarn tensioning device includes a brake plate, a brake plate carrier having an end, a ball and socket device centrally and swivelably supporting the brake plate at the end of the brake plate carrier, and a device disposed outside the ball and socket device for driving the brake plate.

10 Claims, 24 Drawing Figures

ROTATING DRIVEN BRAKE PLATE APPARATUS OF A YARN TENSIONING DEVICE

The invention relates to a driven rotating brake plate apparatus of a thread or yarn tensioning device.

Thread tensioning devices with driven rotating brake plates are known, for instance, from German Published, Non-Prosecuted Application DE-OS No. 33 29 645. In order to permit the brake plate to adjust itself for non-uniformities of the thread or uneven thread guidance, such as when the thread is changing, or an off-center contact occurs, it is already known to place a central, rubber-elastic intermediate member between the drive shaft and the brake plate.

However, such a brake-plate apparatus has a tendency to tilt the brake plate and lead to vibrations which have a disadvantageous effect on the thread. The brake effect is therefore not uniform and the thread is unevenly stressed. Thick portions or slubs in the thread can cause excessive stretching and can lead to thread breakage.

It is accordingly an object of the invention to provide a rotating driven brake plate apparatus of a yarn tensioning device, which overcomes the hereinafore-mentioned disadvantages of the heretofore-known devices of this general type and to make it possible to brake the thread more uniformly without vibrations and in a gentle way, while using high thread winding speeds.

With the foregoing and other objects in view there is provided, in accordance with the invention, a rotating driven brake plate apparatus of a yarn tensioning device, comprising a brake plate, a brake plate carrier having an end, a ball and socket device centrally and swivelably supporting the brake plate at the end of the brake plate carrier, and means disposed outside the ball and socket device for driving the brake plate.

Due to the separation of the brake plate driving device from the brake plate carrying device according to the invention, in conjunction with the capability of the brake plate to swivel and move out of the way, the expected good braking conditions for the thread are achieved. Furthermore, the brake plate cannot assume an eccentric position due to the effects of withdrawing the thread.

In accordance with an added feature of the invention, the ball and socket device includes a socket disposed on the brake plate and a ball disposed on the brake plate carrier.

In accordance with an additional feature of the invention, there is provided a disc holding the brake plate, the ball and socket device including a socket disposed on the disc and a ball disposed on the brake plate carrier.

For example, the ball may be formed of polished and in some cases chromium-plated steel, while the socket or the disc in which the socket is formed, is made of a thermo-plastic synthetic material with self lubricating properties, such as polyoxymethylene (POM). POM has a very high surface hardness and good wear properties.

In accordance with a further feature of the invention, the driving means is a rotation device, and including at least one locking device operatively connected to the rotation device for permitting swiveling of the brake plate or disc.

In accordance with again another feature of the invention, the locking device includes at least one engagement piece connected to the rotation device, the at least one engagement piece having a given cross section and being engaged in at least one opening formed in the disc having a cross section greater than the given cross section.

In order to provide a better locking or driving and better mass distribution, it is advantageous to provide two engagement pieces opposite each other and two corresponding oppositely positioned openings.

In accordance with again an added feature of the invention, there is provided a machine frame, the rotation device including a driven rotating hollow shaft containing the brake plate carrier and being supported on the machine frame and connected to the one or two engagement pieces.

In accordance with again a further feature of the invention, there is provided a controllable loading device for longitudinally moving the brake plate carrier and applying a controllable defined load to the brake plate.

In accordance with still another feature of the invention, the brake plate includes at least one elastic element damping, swiveling and wobbling movements of the brake plate. This is especially advantageous at high speeds.

In accordance with still an added feature of the invention, the brake plate includes a rim and at least one elastic element disposed between the rim and the disc or rotation device for damping swiveling and wobbling movements of the brake plate.

In accordance with still an additional feature of the invention, the elastic element is a rubber-elastic ring or disc.

In accordance with still a further feature of the invention, the brake plate includes a rim, and including a ring bearing against the rim and holding the elastic element. Such a ring may also be formed of a synthetic material, while the brake plate itself as a rule is constructed in the form of a metal dish.

In accordance with yet another feature of the invention there is provided a cover protecting the ball and socket device from dust.

In accordance with yet an additional feature of the invention, there is provided a cover in the form of a disc connected to the rotation device and carrying the at least one engagement piece, for protecting the ball and socket device from dust. However, such a cover does not provide a hermetically-sealed closure.

In accordance with yet a further feature of the invention, the driving means is a rotation device including a driven rotating hollow shaft containing the brake plate carrier and a first ring fastened to the hollow shaft, the brake plate including a rim and a second ring connected to the rim, the ball and socket device including a ball connected to the brake plate carrier and a socket formed in the second ring, and including a rubber-elastic disc disposed between the first and second rings serving as an engagement piece connecting the rotation device to the second ring, as a damping element damping swiveling and wobbling movements of the brake plate, and as a cover protecting the ball and socket device from dust. In this case, the mobility of the brake plate around a central point, the reliable locking or drive, and the dust protected configuration of the brake plate apparatus are fully provided in a special advantageous and simple way.

In accordance with a concomitant feature of the invention, the brake plate includes a rim or ring and and a disc, the ball and socket device includes a ball disposed on the brake plate carrier and a socket formed in the disc, and the elastic element is an O-ring clamped in a ring groove formed in the rim or ring and a ring groove formed in the disc. This permits an easy replacement of the actual brake plate.

Other features which are considered as characteristic for the invention are set forth in the appended claims.

Although the invention is illustrated and described herein as embodied in a rotating driven brake plate apparatus of a yarn tensioning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 4 is a partially cross-sectional, side-elevational view of the brake-plate shown in FIG. 3, as seen in the direction of an arrow a:

Figure 1:
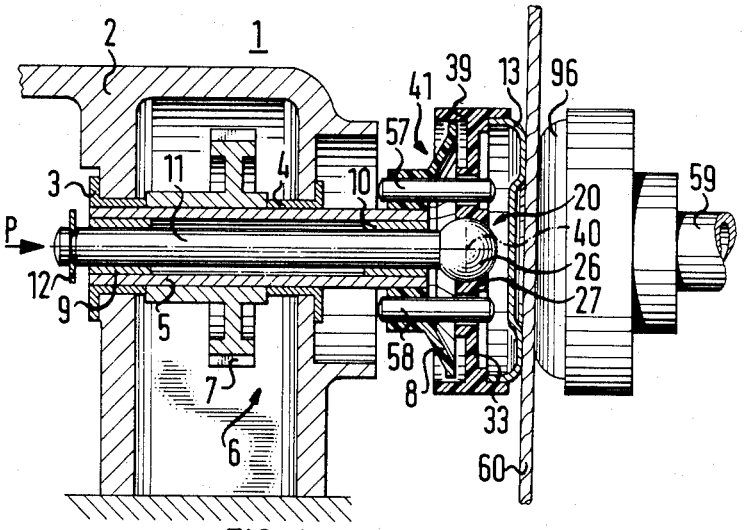
FIG. 1 is a fragmentary, diagrammatic, longitudinal-sectional view of a thread or yarn tensioning device with a first embodiment of a brake plate according to the invention.
Figure 2:
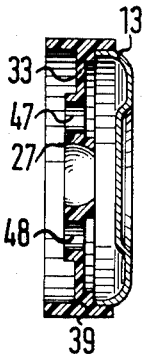
FIG. 2 is a longitudinal-sectional view showing details of the brake plate shown in FIG. 1.
Figure 3:
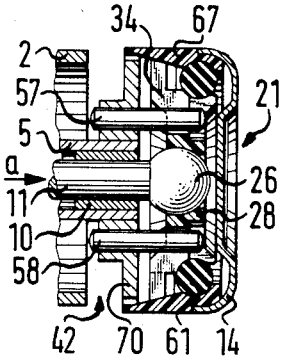
FIG. 3 is a fragmentary, longitudinal-sectional view of a second embodiment of a brake plate.

Referring now to the figures of the drawings in detail and first, particularly, to the first embodiment of the invention shown in FIGS. 1 and 2 thereof, there is seen a thread or yarn tensioning device which is designated as a whole by reference numeral 1 in FIG. 1 and which includes the parts which are essential for an understanding of the invention. The thread tensioning device 1 has a machine frame 2 with sleeve or sliding bearings 3, 4 which serve to support a hollow shaft 5. The hollow shaft 5 is part of a rotation device which is designated as a whole with reference numeral 6. Other parts of the rotation device are a gear 7 which is fastened to the hollow shaft 5 and a disc 8 made of a synthetic material which is disposed at the end of the hollow shaft 5.

A brake plate carrier 11 is supported in the hollow shaft 5 by means of two sleeve or sliding bearings 9 and 10. After its insertion in the hollow shaft 5, the shaft-shaped brake plate carrier 11 is secured against sliding out of the sleeve bearings by a lock washer 12. A loading device P which is only diagrammatically indicated in FIG. 1, is attached to the end of the brake plate carrier 11, in order to make it possible to load the brake plate 13, which will be described in detail below.

The brake plate 13 is centrally supported at the end of the brake plate carrier 11 by a ball and socket device, but the support is provided in such a way that it can swivel and can be driven out of the ball and socket device.

The ball and socket device is designated as a whole with reference numeral 20. A ball 26 is positioned at the end of the brake plate carrier 11. A socket 27 is part of a disc 33 which holds the brake plate 13. The disc 33 has a rim 39 which surrounds the dish-shaped brake plate 13 and holds it securely. While the brake plate 13 is centrally supported in such a way that it can freely swivel about the center 40 of the ball 26, the brake plate 13 is driven by a special locking or driving device, which is designated as a whole with reference numeral 41 and is functionally or operatively connected to the rotating device 6.

The locking device 41 has two mutually opposite openings 47 and 48 formed in the disc 33 which holds the brake plate 13 and the locking device also has two engagement pieces as carriers 57, 58, which are engaged in the openings 47 and 48. The engagement pieces 57 and 58 are positioned in the disc 8 which is connected to the hollow shaft 5. The cross sections of the engagement pieces are smaller than the cross-sections of the openings 47 and 48.

According to FIG. 1, a brake plate 96 which is held by a brake plate carrier 59, is opposite the brake plate 13. The brake plate 96 can be disposed similar to the brake plate 13, but this is not absolutely necessary. Greater details concerning the brake plate 96 are not needed for an understanding of the invention.

During operation, a running thread or yarn 60 is pulled through the thread tensioning device 1. Therefore, at least the brake plate 13 rotates with the help of the gear 7, into which a non-illustrated gear drive is engaged. At the same time, the loading device P pneumatically loads the brake plate carrier 11, such as with a defined force, for example. Since the thread 60 as a rule runs outside of a middle location between the brake plates 13 and 96, the brake plates, or at least the brake plate 13, performs an eccentric motion which, as a result of the apparatus according to the invention, does not negatively influence the thread run or the wear and tear of the brake plate assembly. If the thread 60 has slubs adhering thereto, the brake plate 13 can give way by wobbling, which takes place with the greatest possible careful treatment of the thread.

The second embodiment of the invention according to FIGS. 3 to 7 and 20 to 24 differs from the first embodiment as follows:

A brake plate 14 is shown that has an elastic element, which damps the pivoting and wobbling motions, in the form of an O-ring 61 made of rubber. A ring 67 is provided which bears against the rim 66 of the brake plate, for holding the damping element 61.

The O-ring 61 is clamped in a ring groove 68 of the ring 67 and in an additional ring groove 69 in a disc 34, which includes a socket 28 of a ball and socket device 21.

Figure 20:
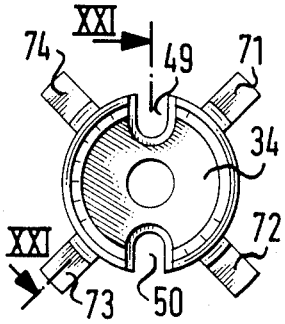
FIG. 20 is a view similar to FIG. 4 showing details of the brake plate of FIG. 3.
Figure 21:
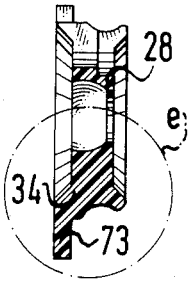
FIG. 21 is a cross-sectional view taken along the line XXI—XXI in FIG. 20, in the direction of the arrows.
Figure 22:
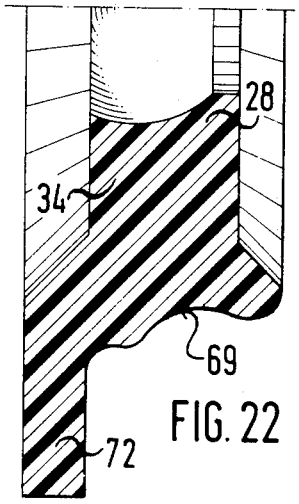
FIG. 22 is an enlarged view of the portion e of FIG. 21.
Figure 24:
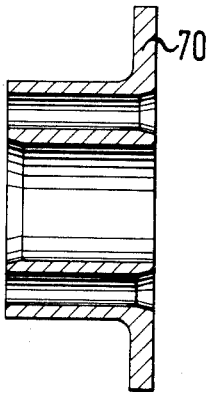
FIG. 24 is a cross-sectional view taken along the line XXIV—XXIV in FIG. 23, in the direction of the arrows.
Figure 23:
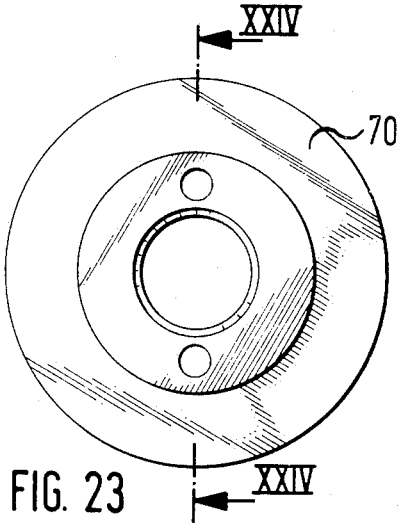
FIG. 23 is a side-elevational view showing details of the brake plates shown in FIGS. 3 and 8.

The disc 34 is shown in particular in FIGS. 20, 21 and 22. According to FIGS. 4 and 20, the disc has two mutually opposite slot-like openings 49 and 50, into which the two engagement pieces or carriers 57, 58 fit with play. The engagement pieces or carriers 57, 58 are disposed in a disc 70, which is shown especially in FIGS. 23 and 24 and which is supported on the hollow shaft 5.

Figure 4:
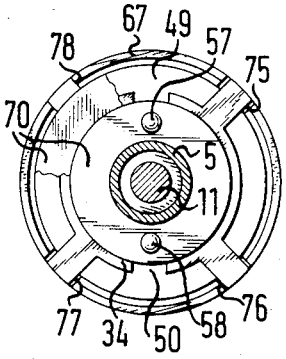
Figure 5:
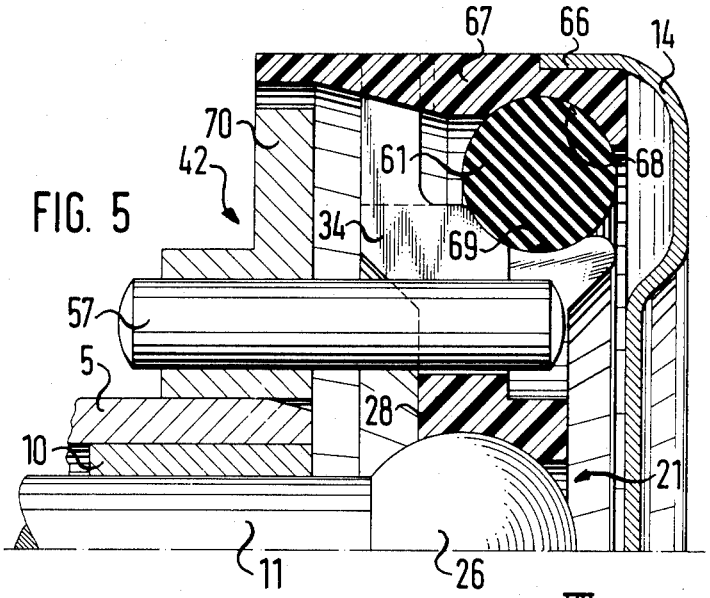
FIG. 5 is an enlarged fragmentary view, showing details of the brake plate shown in FIG. 3.
Figure 7:
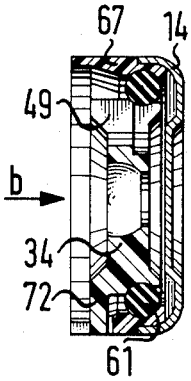
FIG. 7 is a cross-sectional view taken along the line VII—VII in FIG. 6, in the direction of the arrows.
Figure 6:
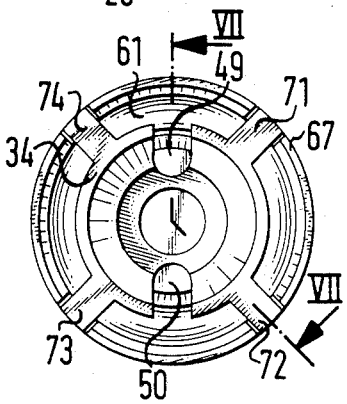
FIG. 6 is a view similar to FIG. 4, of the brake plate shown in FIG. 7, as seen in the direction or an arrow b.
Figure 8:
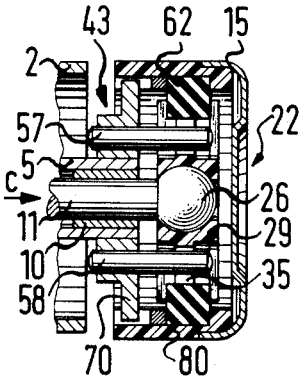
FIG. 8 is a view similar to FIG. 3 of a third embodiment of the brake plate.
Figure 9:
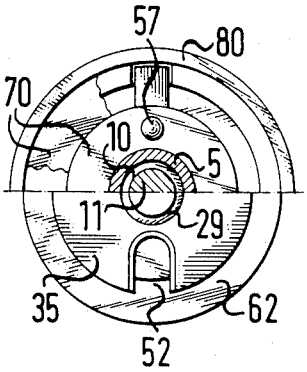
FIG. 9 is a view similar to FIG. 4 of the brake plate shown in FIG. 8, as seen in the direction of an arrow c.

According to FIG. 20, four wings 71, 72, 73, 74 extend outwardly from the disc 34 and according to FIG. 4, the wings fit in four recesses 75, 76, 77 and 78 in the ring 67 with play.

The third embodiment according to FIGS. 8 to 11 differs from the preceding embodiment as follows:

In a ball and socket device 22 of the third embodiment, a socket 29 is disposed in a disc 35 which holds a brake plate 15. The engagement pieces or carriers 57 and 58 of the disc 70 which is a part of a locking or driving device 43, are engaged in slot-like openings 51 and 52 in the disc 35, which are shown especially in FIG. 11 in a view as seen along the direction of an arrow c in FIG. 8.

Figure 10:
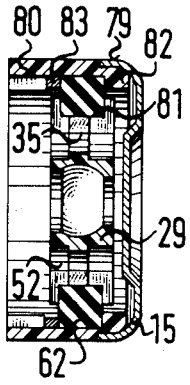
FIG. 10 is a view similar to FIG. 2, showing further details of the brake plate of FIG. 8.
Figure 11:
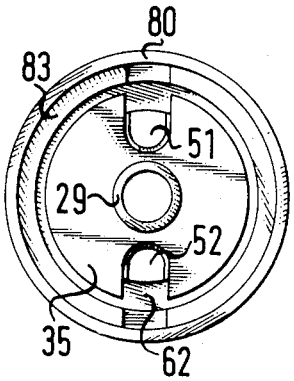
FIG. 11 is a view similar to FIG. 4 showing details of the brake plate of FIG. 8 as seen in the direction of an arrow c.

The cross-sectional view of FIG. 10 shows that a ring 80 is provided which bears against a rim 79 of the brake plate and serves for holding a damping element 62. The damping element 62 is constructed as a rubber-elastic ring with a square cross section, and is disposed in a ring groove 81 in the disc 35. The damping element 62 bears on a shoulder 82 of the ring 80. An additional ring 83 which is pressed in the ring 80, serves for securing the position of the damping element 62 on the ring 80.

Figure 12:
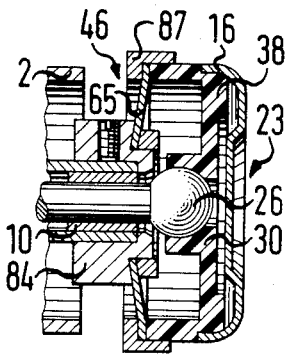
FIG. 12 is a view similar to FIG. 3 of a fourth embodiment of the brake plate.
Figure 13:
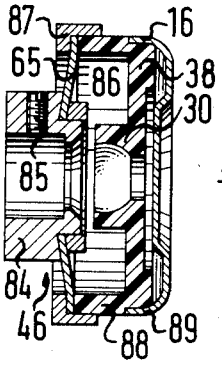
FIG. 13 is a view similar to FIG. 3 showing details of the brake plate of FIG. 12.
Figure 14:
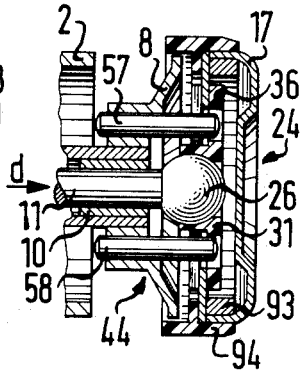
FIG. 14 is a view similar to FIG. 3 of a fifth embodiment of the brake plate.

The fourth embodiment of the invention according to FIGS. 12 and 13, has the following special features:

The socket 30 of the ball and socket device 23, is positioned in a disc or ring 38, which directly carries a brake plate 16. In this case, a locking or driving device 46 has a ring 84 which is fastened to the hollow shaft 5 of the rotation device, while the position of the ring 84 is secured by a set screw 85. In this embodiment, a damping element in the form of a disc 65 serves as an engagement piece or carrier, as a damping element and simultaneously as a dust protector. The disc 65 is fastened by a retaining ring 86 to the ring 84 and by a screw collar ring 87 to a rim 88 of the ring 38. Since an edge 89 of the brake plate 16 is connected with the ring 38 and its rim 88, the disc 65 is also mechanically connected with the brake plate 16.

While FIG. 12 shows a section through the entire device, FIG. 13 represents a section through the rings 38 and 84 and the parts which are connected with the rings.

Figure 16:
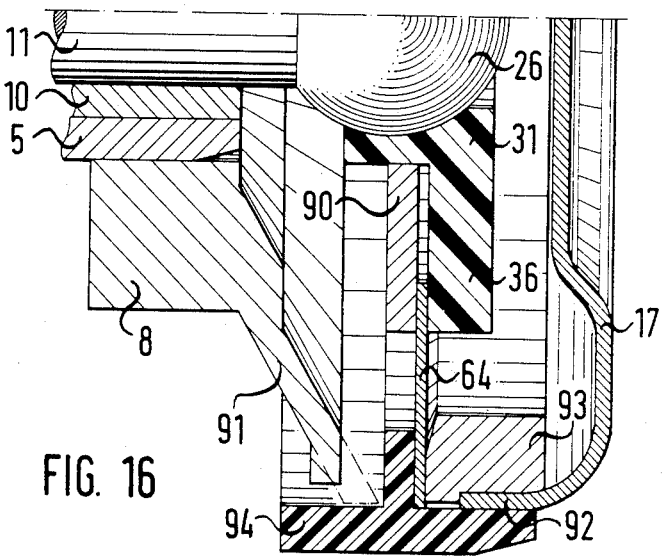
FIG. 16 is a view similar to FIG. 5, showing a half section through the brake plate of FIG. 14.

In the fifth embodiment of the invention according to the FIGS. 14 to 17, the following special features are provided:

In a ball and socket device 24, a socket 31 is disposed in a disc 36, which carries a damping element in the form of a disc 64 with the aid of a ring 90, as especially shown in FIG. 16.

Figure 15:
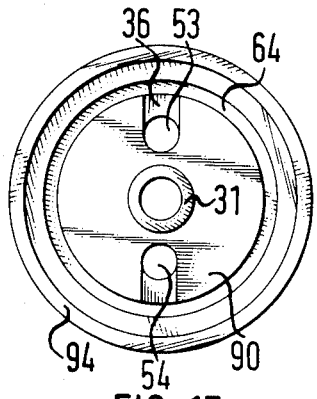
FIG. 15 is a view similar to FIG. 4 of the brake plate of FIG. 14, as seen in the direction of an arrow d.

According to FIG. 15, the disc 36 has circular openings 53 and 54 for receiving the engagement pieces or carriers 57 and 58 of disc 8 of a locking or driving device 44.

The disc 8 includes a special funnel-shaped edge portion 91 which serves as a cover that protects the ball and socket device 24 from dust.

In this case, a rim 92 of a brake plate 17 carries an inner ring 93 and an outer ring 94. The disc 64 is clamped between the inner ring 93 and the outer ring 94, as shown in FIG. 16.

Figure 17:
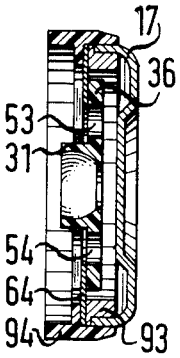
FIG. 17 is a view similar to FIG. 2 showing details of the brake plate of FIG. 14.

While FIG. 15 shows a view of the disc 36 and the damping element 64, FIG. 17 is a section through the brake plate 17, the disc 36, the disc 64 and the rings 93 and 94.

Figure 18:
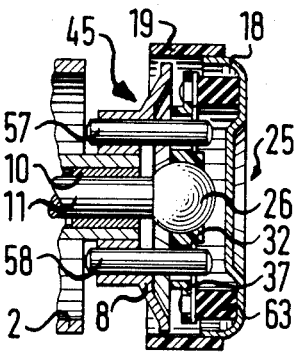
FIG. 18 is a view similar to FIG. 3 of a sixth embodiment of the brake plate.
Figure 19:
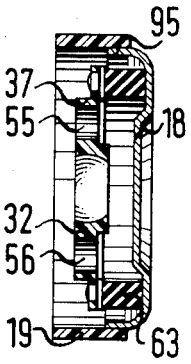
FIG. 19 is a view similar to FIG. 2 showing details of the brake plate of FIG. 18.

The sixth embodiment of the invention has the following special features, according to FIGS. 18 and 19:

According to FIG. 18, a ball and socket device 25 has a socket 32 disposed in a disc 37 which carries a brake plate 18. A locking or driving device 45 is provided with the same engagement pieces or carriers 57 and 58 and the same disc 8 as in the preceding embodiment. Oppositely disposed openings 55 and 56 for the engagement pieces or carriers 57 and 58 are provided in the disc 37. The openings are shown especially in the cross-sectional view of FIG. 19. This figure also shows that a damping element 63 in the form of a rubber-elastic ring with a rectangular cross section is fastened to the outer rim of the disc 37. The damping element 63 is cemented to the brake plate 18. A ring 19, which is cemented to an edge 95 of the brake plate, serves as a cover which protects the ball and socket device 25 from dust.

The rings which have the sockets are all made of a thermoplastic synthetic material. The socket always surrounds the ball itself, so that during assembly and disassembly a certain resistance must be overcome in order to insert the ball into and remove the ball from the socket. This configuration of the socket is shown clearly in FIGS. 5 and 16. Generally, the invention is not limited to the illustrated and described embodiments which are used as examples.

For instance, in the embodiment according to FIG. 16, the edge portion 91 of the disc 8 could be elongated to the point where it approaches the outer ring 94, thereby serving as a hermetically sealing cover preventing contamination of the ball and socket device 24. In this case it would be practical to make the edge portion 91 of the disc 8 out of a rubber-elastic material.

I claim:

1. Rotating driven brake plate apparatus of a yarn tensioning device, comprising a brake plate, a brake plate carrier having an end, a ball and socket device centrally and swivelably supporting said brake plate at said end of said brake plate carrier, means in the form of a rotation device disposed outside said ball and socket device for driving said brake plate, a disc holding said brake plate, said ball and socket device including a socket disposed on said disc and a ball disposed on said brake plate carrier, and at least one locking device operatively connected to said rotation device for permitting swiveling of said disc, said locking device including at least one engagement piece connected to said rotation device, said at least one engagement piece having a given cross section and being engaged in at least one opening formed in said disc having a cross section greater than said given cross section.

2. Brake plate apparatus according to claim 1, including a machine frame, said rotation device including a driven rotating hollow shaft containing said brake plate carrier and being supported on said machine frame and connected to said at least one engagement piece.

3. Brake plate apparatus according to claim 1, including a controllable loading device for longitudinally moving said brake plate carrier and applying a controllable defined load to said brake plate.

4. Brake plate apparatus according to claim 1, including a cover protecting said ball and socket device from dust.

5. Brake plate apparatus according to claim 1, including a cover in the form of a disc connected to said rotation device and carrying said at least one engagement piece, for protecting said ball and socket device from dust.

6. Rotating driven brake plate apparatus of a yarn tensioning device, comprising a brake plate, a brake plate carrier having an end, a ball and socket device centrally and swivelably supporting said brake plate at said end of said brake plate carrier, means disposed outside said ball and socket device for driving said brake plate, a disc holding said brake plate, said ball and socket device including a socket disposed on said disc and a ball disposed on said brake plate carrier, and said brake plate including a rim and at least one elastic element disposed between said rim and said disc for damping swiveling and wobbling movements of said brake plate.

7. Rotating driven brake plate apparatus of a yarn tensioning device, comprising a brake plate, a brake plate carrier having an end, a ball and socket device centrally and swivelably supporting said brake plate at said end of said brake plate carrier, means in the form of a rotation device disposed outside said ball and socket device for driving said brake plate, said ball and socket device including a socket disposed on said brake plate and a ball disposed on said brake plate carrier, and at least one locking device operatively connected to said rotation device for permitting swiveling of said brake plate, said brake plate including a rim and at least one elastic element disposed between said rim and said rotation device for damping swiveling and wobbling movements of said brake plate.

8. Rotating driven brake plate apparatus of a yarn tensioning device, comprising a brake plate, a brake plate carrier having an end, a ball and socket device centrally and swivelably supporting said brake plate at said end of said brake plate carrier, means disposed outside said ball and socket device for driving said brake plate, said driving means being in the form of a rotation device including a driven rotating hollow shaft containing said brake plate carrier and a first ring fastened to said hollow shaft, said brake plate including a rim and a second ring connected to said rim, said ball and socket device including a ball connected to said brake plate carrier and a socket formed in said second ring, and a rubber-elastic disc disposed between said first and second rings serving as an engagement piece connecting said rotation device to said second ring, as a damping element damping swiveling and wobbling movements of said brake plate, and as a cover protecting said ball and socket device from dust.

9. Rotating driven brake plate apparatus of a yarn tensioning device, comprising a brake plate, a brake plate carrier having an end, a ball and socket device centrally and swivelably supporting said brake plate at said end of said brake plate carrier, means disposed outside said ball and socket device for driving said brake plate, said brake plate including at least one elastic element damping swiveling and wobbling movements of said brake plate, a rim and and a disc, said ball and socket device including a ball disposed on said brake plate carrier and a socket formed in said disc, and said elastic element being in the form of an O-ring clamped in a ring groove formed in said rim and a ring groove formed in said disc.

10. Rotating driven brake plate apparatus of a yarn tensioning device, comprising a brake plate, a brake plate carrier having an end, a ball and socket device centrally and swivelably supporting said brake plate at said end of said brake plate carrier, means disposed outside said ball and socket device for driving said brake plate, said brake plate including at least one elastic element damping swiveling and wobbling movements of said brake plate, a ring and and a disc, said ball and socket device including a ball disposed on said brake plate carrier and a socket formed in said disc, and said elastic element being in the form of an O-ring clamped in a ring groove formed in said ring and a ring groove formed in said disc.

* * * * *